US006094939A

United States Patent [19]

Gavello

[11] Patent Number: 6,094,939

[45] Date of Patent: Aug. 1, 2000

[54] JEWELRY ITEM

[75] Inventor: Rinaldo Gavello, Milan, Italy

[73] Assignee: Rinaldo Gavello, S.r.L., Milan, Italy

[21] Appl. No.: 08/953,197

[22] Filed: Oct. 17, 1997

[30] Foreign Application Priority Data

Oct. 18, 1996 [IT] Italy ..... MI96A2164

[51] Int. Cl.[7] ..... A44C 5/00

[52] U.S. Cl. ..... 63/3; 63/4; 63/5.1; 63/11; 63/38; 59/79.1; 59/80; 59/82; D11/3; D11/6; D11/8; D11/11

[58] Field of Search ..... 63/1.16, 3, 4, 5.1, 63/5.2, 11, 21, 35, 38; 59/78, 79.1, 80, 82, 83; D11/3, 6, 8, 11

[56] References Cited

U.S. PATENT DOCUMENTS

| | | | |
|---|---|---|---|
| D. 316,831 | 5/1991 | Bulgari | D11/6 |
| 427,593 | 5/1890 | Mathewson | 63/11 |
| 1,166,629 | 1/1916 | Pratt | 63/3 |
| 1,201,262 | 10/1916 | Cox | 63/3 |
| 1,403,600 | 1/1922 | Grand et al. | 63/11 |
| 1,481,894 | 1/1924 | Fishel | 63/4 |
| 1,570,932 | 1/1926 | Anderson et al. | 63/11 X |
| 1,694,703 | 12/1928 | Doppenschmitt | 63/11 |
| 2,282,336 | 5/1942 | Meyer | 63/11 X |
| 2,852,923 | 9/1958 | Gamelsky | 63/4 X |
| 4,305,262 | 12/1981 | Ferrara | 63/3 X |
| 4,351,166 | 9/1982 | Belin | 63/5.1 X |
| 4,551,993 | 11/1985 | Nagahori | 63/38 X |
| 5,440,900 | 8/1995 | White | 63/38 |

FOREIGN PATENT DOCUMENTS

| | | | |
|---|---|---|---|
| 24764 | 8/1904 | United Kingdom | 63/4 |
| WO 94/16592 | 8/1994 | WIPO | 63/3 |

*Primary Examiner*—Terry Lee Melius
*Assistant Examiner*—Andrea Chop
*Attorney, Agent, or Firm*—Kirschstein, et al.

[57] ABSTRACT

A jewelry item includes a plurality of components mounted in an end-to-end relationship on and along an annular, elastic support. Each component has two, generally planar end walls and an aperture for receiving the support and extending between the end walls. The end walls of adjacent components engage each other in surface area contact. The support can be a strap or a pair of wires. At least one of the components has a setting for a gemstone.

4 Claims, 4 Drawing Sheets

JEWELRY ITEM

BACKGROUND OF THE INVENTION

The invention relates to a component for making necklaces, bracelets, earrings, rings and the like.

Components are known which are used to make jewelery and costume jewelery—for example, from precious materials such as gold, platinum or silver—and which are decorative and designed to be joined together.

Irrespective of the shape of the decorative elements, they nevertheless have a first part with connection means and a second part bearing decorative elements or settings for stones or gems.

To this end the components—which are made from precious materials and, for example, form claw mounts—have hinges on their bases or collet bases, these hinges housing pins for connection to other structural elements of the piece of jewelery.

Alternatively, the piece is made up by linking together rings which have been welded to the sides of the body of the claw mount.

Joining or linking the various claw mounts together using these connection means is an extremely laborious process.

The process is made so laborious mainly because, in the first case, the shapes used to link the claw mounts together are complex to produce and, in the second case, a great many connection rings need to be welded to the claw mounts in order to make up the pieces of jewelery. The whole process is made even more lengthy and complex by the fact that the components are so small—the claw mounts used to make bracelets and necklaces can be as small as 3–5 millimeters in length.

Furthermore, the need to produce components that are both extremely precise, so that the finished piece of jewelery is of extremely high quality, and secure, in order to avoid them working loose accidentally—means that the work involved in linking the claw mounts together needs to be extremely accurate and slow.

Also, linking the claw mounts together in this way makes the piece of jewelery thus produced rather inelastic, which means that it is difficult to put on and fasten.

What is more, components that have been linked together tend to rotate easily on themselves while they are being worn, thereby hiding the decorative element or gemstone from view.

SUMMARY OF THE INVENTION

The object of the present invention is to overcome the disadvantages of the prior art listed above and to simplify production of the component and the connection means needed to make up pieces of jewelery or costume jewelery, thereby reducing production times.

A further object of the invention concerns increasing the elasticity of the piece of jewelery made up from the various components and preventing it from rotating on itself while it is being worn.

The objects of the invention are achieved by means of a component for making necklaces, bracelets, earrings, rings and the like, characterized in that the component consists of a shaped body which has a base with at least one through aperture and in that the through aperture accommodates at least one support wire.

Advantageously, the component is characterized in that the base has two parallel through holes that accommodate the support wires.

Advantageously, the component is characterized in that the base has a through aperture whose cross-section is elongated in the transverse direction and is preferably rectangular, and in that the support wire is made in the form of a strap.

Advantageously, the support wires or strap accommodate a plurality of components.

Advantageously, the component is characterized in that one or more components form modular units for making jewelery or costume jewelery.

Another advantage is that the support wires or strap are elastically deformable.

Advantageously, the components supported by the support wires or strap come into contact with each other.

Another advantage is that there are grooves in the external side of the shaped body that run parallel with the holes that accommodate the support wires.

Advantageously, the component is characterized in that there are grooves in the sides of the shaped body that run transverse to the through aperture.

A further advantage is that the base of the component is joined to a decorative shaped body.

Advantageously, claws project from the shaped body of the component to form settings for gemstones.

Another advantage is that the shaped body has a through hole between the claws of the setting.

A further advantage is that joining a plurality of components together forms a necklace.

Advantageously, joining a plurality of components together forms a bracelet.

Another advantage is that joining a plurality of components together forms an earring.

Advantageously, joining the components together forms a ring.

The advantages of the present invention essentially consist in considerably simplifying component production and, consequently, reducing production times, while still maintaining a high quality finished product.

A further advantage consists in simplifying the process whereby the elements are joined together in order to form pieces of jewelery or costume jewelery.

A further advantage is the greater elasticity of the piece once the various components have been joined together, which elasticity is dependent on the flexibility of the support wires and can, therefore, be modified by altering the elastic characteristics of the support wires.

Another advantage is that the various components are connected together by means of a plurality of parallel wires. Connection by means of parallel wires reduces the probability of the string of components twisting accidentally, thereby avoiding the situation where the decorative part of the elements or the gemstones set in the latter are hidden from view while the piece of jewelery is being worn.

BRIEF DESCRIPTION OF THE DRAWINGS

The subject, as envisaged by the present invention, will now be described in greater detail and illustrated by means of an embodiment given solely by way of example and shown in the appended drawings, in which.

DESCRIPTION OF THE PREFERRED EMBODIMENTS

Figure 1:
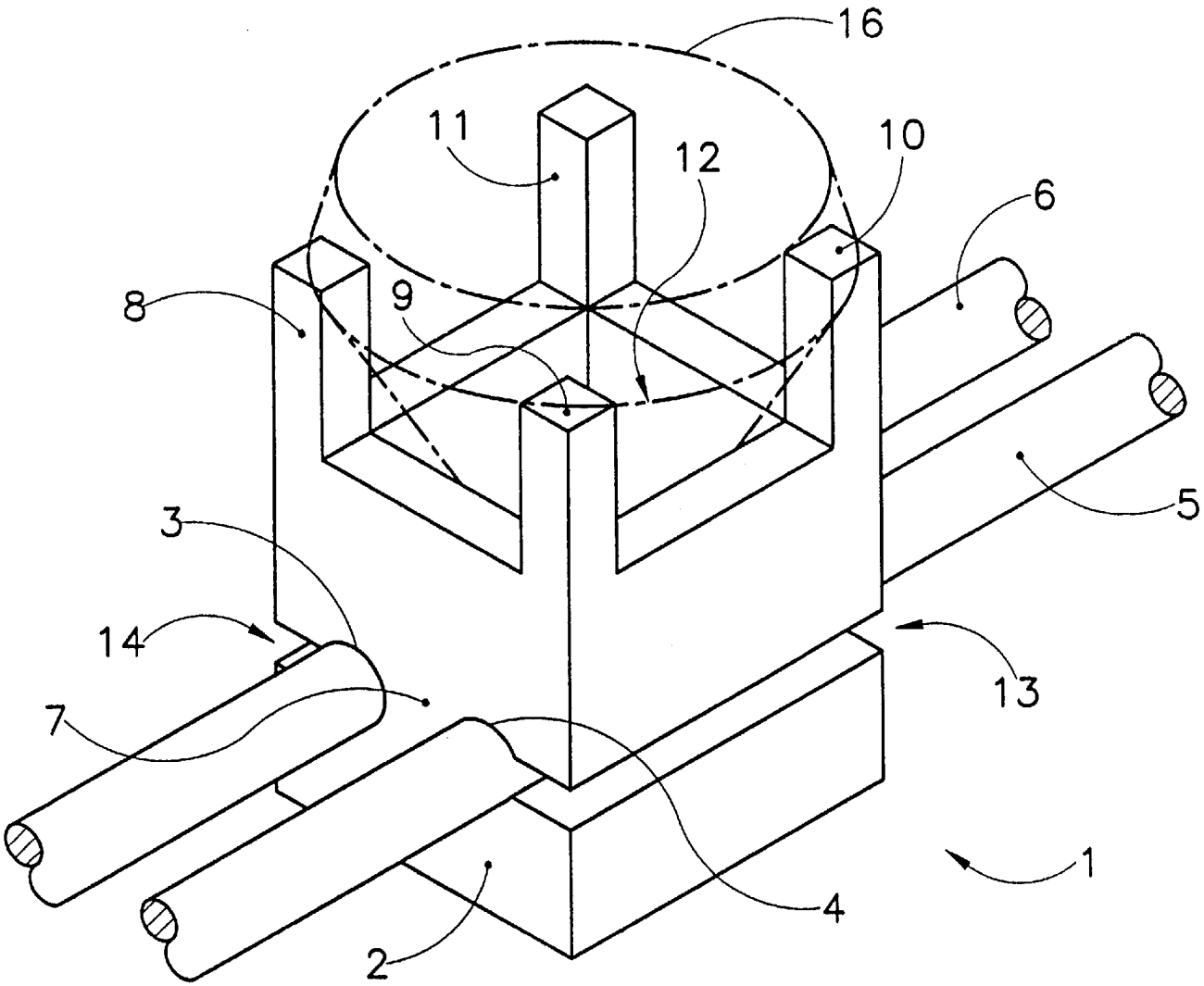
FIG. 1 illustrates, diagrammatically and in isometric view, a claw mount supported by two support wires.

FIG. 1 shows how a claw mount, denoted overall by the reference 1, consists of a prismatic shaped body.

Advantageously, this claw mount can be made with a body having a circular or oval cross-section.

There is a collet base 2 at the base of the shaped body. Formed in the sides of the collet base 2 are two through holes 3, 4 of circular cross-section which accommodate support wires 5, 6.

Advantageously, the holes 3, 4 accommodating the support wires 5, 6 can also be made with a triangular, square or oval cross-section, as can the support wires 5, 6.

The collet base 2 is connected to the rest of the body of the claw mount 1 by the crosspiece 7. At the top, the body of the claw mount 1 is joined to four claws 8, 9, 10, 11 located on the corners of the upper base of the prismatic body of the claw mount 1.

The number of claws 8, 9, 10, 11 and their position on the top of the claw mount 1 depends on the cross-section of the claw mount 1 body and on the size of the stone or gem 16 to be set therein.

Advantageously, there is a through hole 12 at the center of the claws 8, 9, 10, 11.

A further advantage is that there are two grooves 13, 14 in the sides of the claw mount 1 body that run parallel with the holes 3, 4 housing the support wires 5, 6 and join up with the said holes 3, 4.

Figure 2:
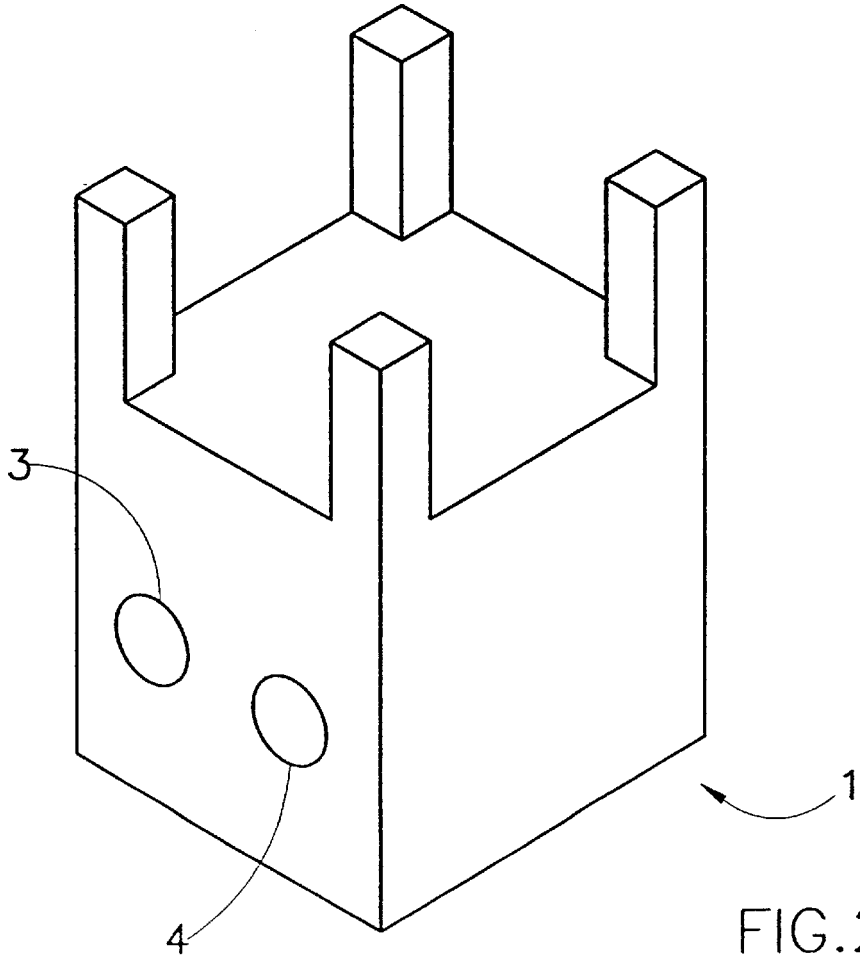
FIG. 2 illustrates, diagrammatically and in isometric view, a second claw mount.

FIG. 2 shows a second embodiment of the claw mount 1 in which the body is prismatic in shape and does not have any grooves or holes except for the parallel holes 3 and 4 which house the support wires.

Figure 3:
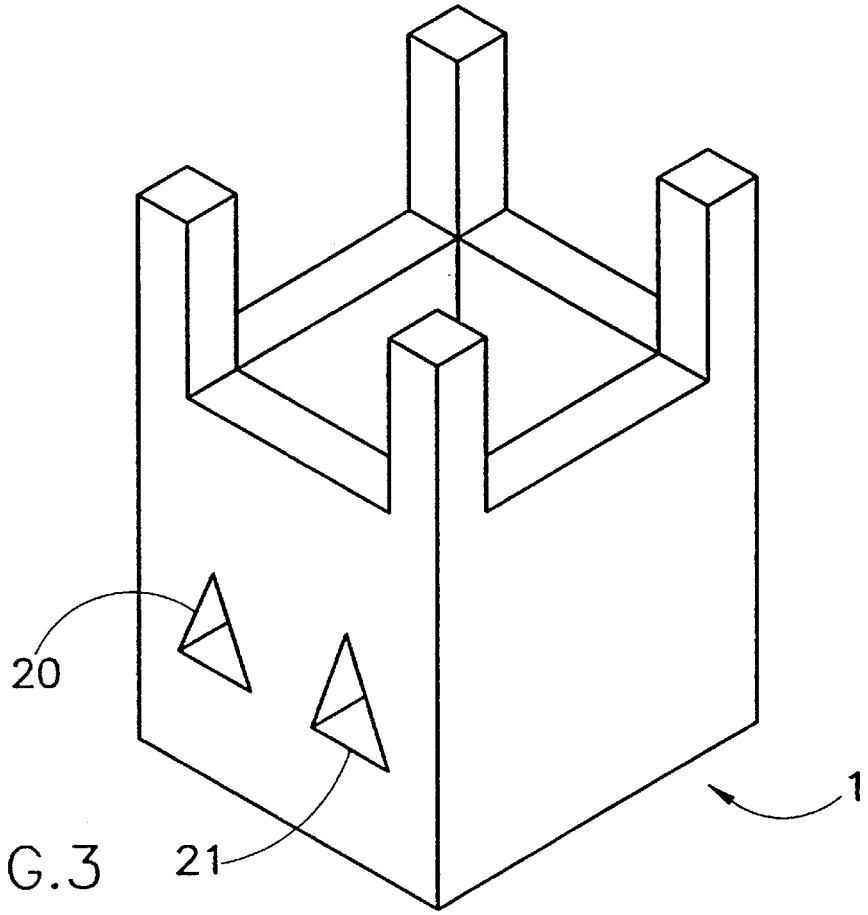
FIG. 3 shows, diagrammatically and in isometric view, a third embodiment of the claw mount.

FIG. 3 shows a claw mount 1 in which the parallel transverse holes for the support wires have a triangular cross-section. The support wires, which make it possible to join this claw mount 1 to similar claw mounts, will also advantageously have a triangular cross-section.

Figure 4:
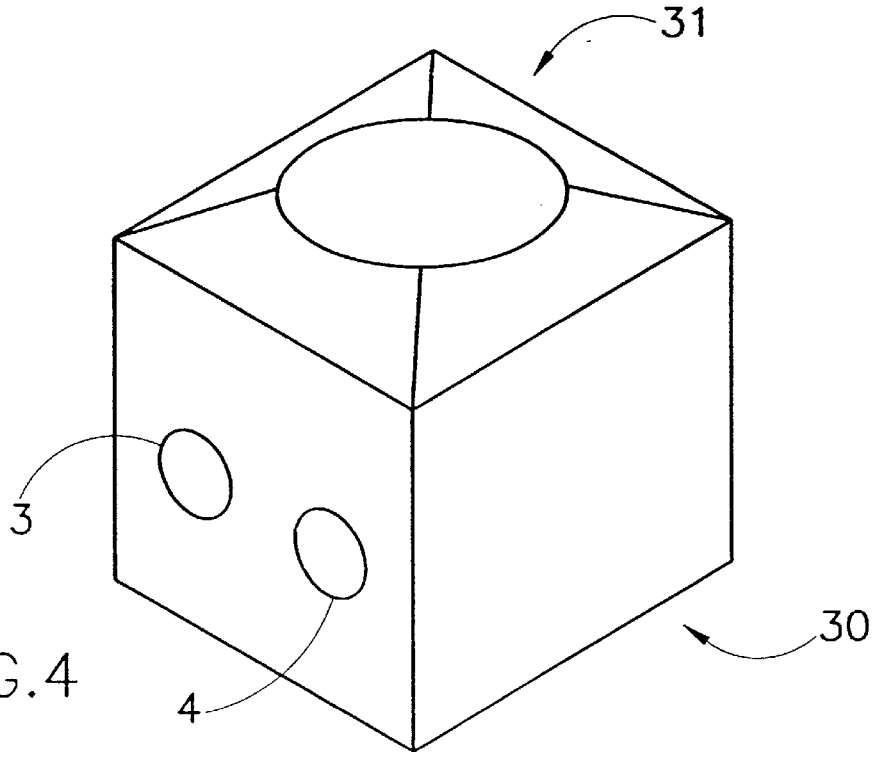
FIG. 4 illustrates, diagrammatically and in isometric view, a component with decorative means.

FIG. 4 shows a component 30 which has a decorative shape 31 at the top and two transverse through holes 3, 4 in the sides, these holes housing support wires.

Figure 6:
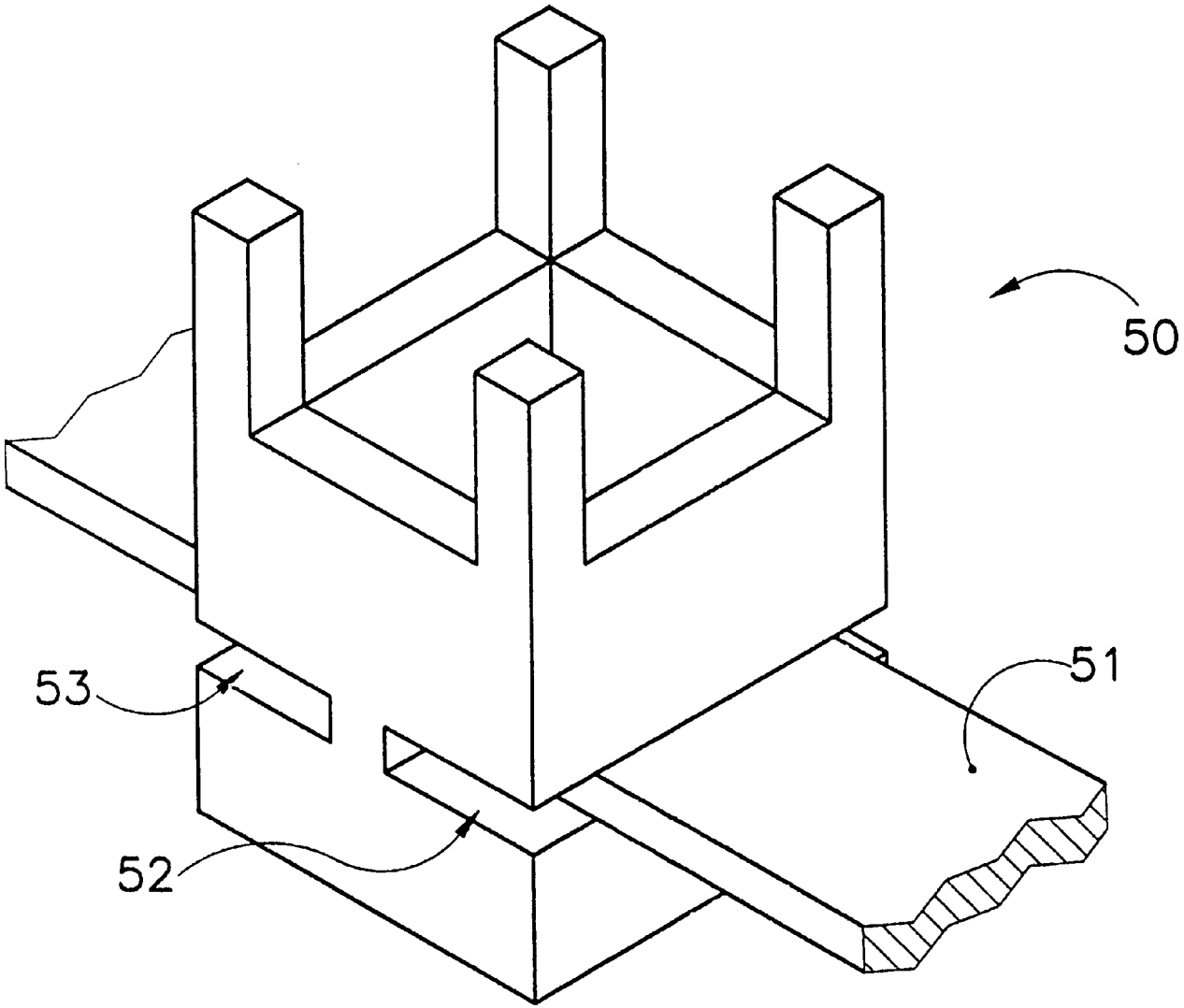
FIG. 6 illustrates, diagrammatically and in isometric view, a claw mount threaded on to a strap.

FIG. 6 shows a different advantageous embodiment of the invention.

The claw mount, which is denoted overall in the figure by the reference 50, has a single through aperture in the base of the shaped body of roughly rectangular cross-section.

Advantageously, the aperture can also be oval in shape or at any rate have a shape that is elongated transversely. Two grooves 52, 53 are made in the sides of the shaped body, where the aperture is located. The claw mount 50 is threaded on to a wire 51 that forms a strap, the latter's cross-section being of the same shape as the aperture in the claw mount 50.

Figure 5:
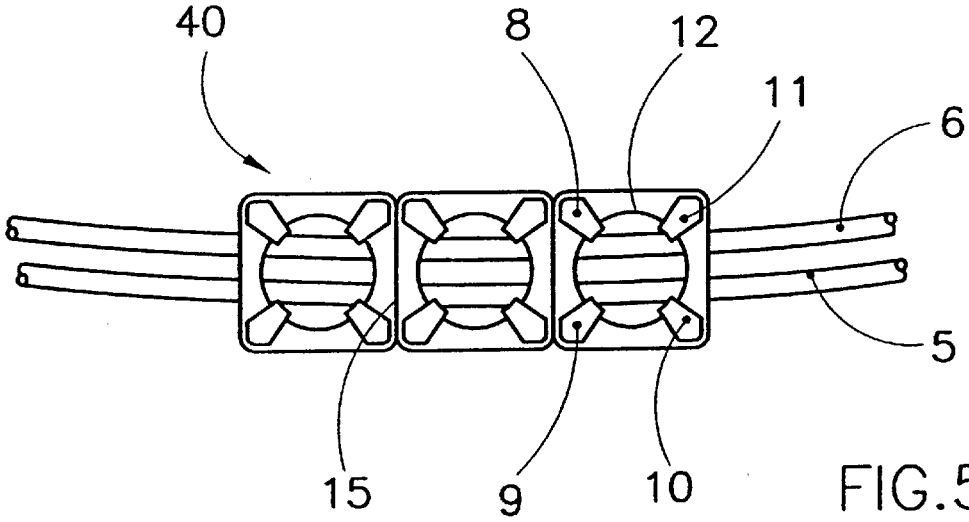
FIG. 5 illustrates three claw mounts threaded on to two support wires, seen from above.

Looking at FIG. 5 it is possible to see a different embodiment of the invention and the way in which it works.

The figure shows three claw mounts 40 which have been linked together on support wires 5, 6. The view from above shows the rhomboid cross-section of the claws 8, 9, 10, 11 of the setting and the circular shape of the through hole 12 in the center of the claws 8, 9, 10, 11.

When a piece of jewelery is to be made, support wires 5, 6 having different cross-sections and lengths and made from suitable materials are selected according to the length and flexibility required.

The components, for example the claw mounts 40, are threaded on to the support wires 5, 6 via the parallel through holes 3, 4, the cross-section and dimensions of which match those of the connection wires. The sides 15 of the claw mount 40 bodies come into contact with each other, forming a continuous shape. The piece of jewelery thus produced is pleasingly smooth and streamlined.

Although in an embodiment with conventional connections the fact that the sides 15 of the claw mount 40 bodies come into contact with each other would result in a particularly rigid piece, with the solution proposed herein, the piece retains its flexible characteristics—which are dictated by the elastic properties of the support wires 5, 6.

This solution lends itself to a number of ways of joining the components together. For example, if a ring is to be made, it is possible to use elements without any claws for the sides and the lower part of the ring and elements with claws for setting gemstones 16 in the upper part. These elements can also have different cross-sections so as to house gemstones 16 of different carat weights.

What is claimed is:

1. A jewelry item, comprising:

a) a pair of elongated, elastic wires, each capable of returning to an initial shape after elastic deformation; and b) a plurality of jewelry components mounted in an end-to-end relationship on and along each wire, each component having a pair of exterior, planar, end walls spaced apart in mutual parallelism, and a pair of openings for receiving the respective wires, each opening extending from one to the other of the end walls within a respective component, an end wall of one of the components engaging in surface area contact an end wall of another of the components that is adjacent the one component along the respective wires, each component having a pair of exterior, planar, side walls extending substantially perpendicularly to the end walls to form each component as a four-sided body, each component having a pair of grooves extending from said one to said other of the end walls of the respective component, each groove extending from a respective side wall to a respective opening.

2. The jewelry item according to claim 1, wherein each opening has a generally circular cross-section.

3. The jewelry item according to claim 1, wherein each opening has a generally triangular cross-section.

4. The jewelry item according to claim 1, wherein at least one of the components has a setting for a gemstone.

* * * * *